US007567420B2

(12) United States Patent
Kobayashi et al.

(10) Patent No.: US 7,567,420 B2
(45) Date of Patent: Jul. 28, 2009

(54) ELECTROSTATICALLY ATOMIZING DEVICE

(75) Inventors: Kentaro Kobayashi, Nishinomiya (JP); Hirokazu Yoshioka, Osaka (JP); Tomoharu Watanabe, Osaka (JP); Akihide Sugawa, Hikone (JP); Shousuke Akisada, Hikone (JP); Toshihisa Hirai, Hikone (JP); Kishiko Hirai, legal representative, Hikone (JP); Fumio Mihara, Hikone (JP); Kouichi Hirai, Hikone (JP); Shinya Murase, Hikone (JP); Atsushi Isaka, Hikone (JP); Osamu Imahori, Hikone (JP); Sumio Wada, Hikone (JP); Tatsuhiko Matsumoto, Habikino (JP)

(73) Assignee: Matsushita Electric Works, Ltd., Kadoma (JP)

( * ) Notice: Subject to any disclaimer, the term of this patent is extended or adjusted under 35 U.S.C. 154(b) by 482 days.

(21) Appl. No.: 11/547,564

(22) PCT Filed: Apr. 5, 2005

(86) PCT No.: PCT/JP2005/006641
§ 371 (c)(1),
(2), (4) Date: Oct. 5, 2006

(87) PCT Pub. No.: WO2005/097339

PCT Pub. Date: Oct. 20, 2005

(65) Prior Publication Data

US 2008/0130189 A1 Jun. 5, 2008

(30) Foreign Application Priority Data

| | | |
|---|---|---|
| Apr. 8, 2004 | (JP) | 2004-114364 |
| Jun. 18, 2004 | (JP) | 2004-181652 |
| Aug. 27, 2004 | (JP) | 2004-248976 |
| Oct. 28, 2004 | (JP) | 2004-314689 |

(51) Int. Cl.
*B05B 5/053* (2006.01)
*F25C 1/00* (2006.01)

(52) U.S. Cl. ..... 361/228; 361/226; 361/225; 62/129; 62/135

(58) Field of Classification Search ..... 361/228, 361/226, 225; 62/129, 135
See application file for complete search history.

(56) References Cited

U.S. PATENT DOCUMENTS 5,203,989 A * 4/1993 Reidy ..... 210/137

(Continued)

FOREIGN PATENT DOCUMENTS

EP 0 486 198 A1 5/1992

(Continued)

OTHER PUBLICATIONS

Notification of Reason(s) for Refusal mailed on Dec. 2, 2008, issued on Japanese Patent Application No. 2004-114364 and the English translation thereof.

*Primary Examiner*—Stephen W Jackson
*Assistant Examiner*—Zeev Kitov
(74) *Attorney, Agent, or Firm*—Edwards Angell Palmer & Dodge LLP

(57) ABSTRACT

An electrostatically atomizing device includes an emitter electrode, an opposed electrode opposed to the emitter electrode, and a cooling means which condenses the water on the emitter electrode from within the surrounding air, and a high voltage source applying a high voltage across the emitter electrode and the opposed electrode to electrostatically charge the water for atomizing charged minute water particles from a discharge end of the emitter electrode. The device further includes a controller for discharging the charged minute water particles in a stable manner. The controller monitors a discharge current flowing between the two electrodes to control the cooling means for keeping the discharge current at a predetermined level, thereby regulating the atomizing amount of the charged minute particles from the emitter electrode.

19 Claims, 8 Drawing Sheets

U.S. PATENT DOCUMENTS

| | | | | |
|---|---|---|---|---|
| 5,337,963 | A | 8/1994 | Noakes | |
| 6,182,453 | B1 * | 2/2001 | Forsberg | 62/125 |
| 6,471,753 | B1 * | 10/2002 | Ahn et al. | 96/27 |
| 6,755,037 | B2 * | 6/2004 | Engel et al. | 62/177 |
| 7,089,763 | B2 * | 8/2006 | Forsberg et al. | 62/635 |
| 7,494,532 | B2 * | 2/2009 | Azukizawa et al. | 96/27 |
| 2006/0131449 | A1 | 6/2006 | Azukizawa et al. | |

FOREIGN PATENT DOCUMENTS

| | | |
|---|---|---|
| JP | 62-144774 | 6/1987 |
| JP | 5-345156 | 12/1993 |
| JP | 11-56994 | 3/1999 |
| JP | 2001-286546 | 10/2001 |
| JP | 3260150 | 2/2002 |
| JP | 2002-203657 | 7/2002 |
| JP | 2003-14261 | 1/2003 |
| JP | 2003-79714 | 3/2003 |
| JP | 2004-358362 | 12/2004 |
| JP | 4016934 | 5/2005 |

* cited by examiner

ELECTROSTATICALLY ATOMIZING DEVICE

TECHNICAL FIELD

The present invention relates to an electrostatically atomizing device, and more particularly to the electrostatically atomizing device which condenses water contained in the air and electrostatically charge the condensed water so as to atomize the minute water particles of a nanometer order.

BACKGROUND ART

Japanese patent publication No. 5-345156 A discloses a prior art electrostatically atomizing device generating charged minute water particles of a nanometer order (nanometer sized mist). The device is configured to apply a high voltage across an emitter electrode supplied with the water and an opposed electrode to induce Rayleigh disintegration of the water carried on the emitter electrode, thereby atomizing the water. The charged minute water particles thus obtained contain radicals and remain over a long period of time to be diffused into a space in a large amount, thereby being allowed to react effectively with offensive odors adhered to a room wall, clothing, or curtains to deodorize the same.

However, since the above device relies upon a water tank containing the water which is supplied through a capillary effect to the emitter electrode, it enforces the user to replenish the tank. In order to eliminate the inconvenience, it may be possible to use a heat exchanger which condense the water by cooling the surrounding and supply the water condensed at the heat exchanger to the emitter electrode. However, this scheme poses a problem that it will take at least several minutes to obtain the water (condensed water) generated at the heat exchanger and supply the condensed water to the emitter electrode.

DISCLOSURE OF THE INVENTION

In view of the above problem, the present invention has been accomplished to give a solution of providing an electrostatically atomizing device which is capable of eliminating the necessity of supplying the water and assuring to maintain a stable discharging condition for generation of nano-meter sized mist.

The electrostatically atomizing device in accordance with the present invention includes an emitter electrode, an opposed electrode opposed to the emitter electrode, a cooling means configured to condense the water on the emitter electrode from within the surrounding air; and a high voltage source configured to apply a high voltage across said emitter electrode and said opposed electrode to electrostatically charge the water on the emitter electrode for atomizing charged minute water particles from a discharge end of the emitter electrode. The device further includes a controller. The controller is configured to give an atomization control mode in which the controller monitors a parameter indicative of a discharging condition of the emitter electrode and controls said cooling means based upon the monitored parameter for regulating an atomizing amount of the charged minute water particles.

Preferably, the above parameter is given by a discharge current flowing between the emitter electrode and the opposed electrode such that the cooling means varies a cooling rate based upon the discharge current for regulating the amount of the water condensed on the emitter electrode, which assures to give an atomizing amount of the charged minute water particles in a stable manner. Since the discharge current is proportional to the amount of the charged minute water particles being discharged from the emitter electrode, the discharge amount of the charged minute water particles can be optimally regulated by controlling to maintain the discharge current.

In this instance, the controller is configured to hold a target discharge current table defining a target discharge current which varies in accordance with the high voltage applied across the two electrodes. The controller operates in the atomization control mode to collect time series data of the said high voltage as well as the discharge current and to read a first voltage and a first current at a first time, and read a second current at a subsequent second time. The controller reads the target discharge current from the target discharge current table in correspondence to the first voltage, and calculates a discharge current variation between the second current and the first current, and a target current error between the target discharge current and the second current. Then, the controller operates in the atomization control mode to determine a correction as a function of the discharge current variation and the target current error so as to correct the currently obtained cooling rate by the correction. After the second time, the controller controls the cooling means to cool the emitter electrode at thus corrected cooling rate, and repeats a cycle of determining the corrected cooling rate with regard to subsequent ones of the time series data. With this control, it is possible to keep the discharge current constant, i.e., to discharge a constant amount of the charged minute water particles from the emitter electrode. The non-corrected cooling rate can be obtained from the environmental temperature, the environmental humidity, and the emitter electrode at that time.

The target discharge current table is preferred to include a compensation parameter which varies with the cooling rate so that the controller modifies the corrected cooling rate by the compensation parameter, assuring more precise temperature control for realizing an optimum amount of condensed water or an optimum discharge amount of the charged minute water particle.

Also, the controller is configured to give an initial cooling control mode for cooling said emitter electrode without applying the high voltage across the two electrodes. The controller operates in the initial cooling control mode to monitor an environmental temperature and an environmental humidity of the surrounding air, as well as an electrode temperature of the emitter electrode. In this connection, the controller is configured to hold a target electrode temperature table defining a target electrode temperature which varies with the environmental temperature and humidity, and a cooling rate table defining a cooling rate which varies with a temperature difference between the target electrode temperature and the electrode temperature. The controller operates in the initial cooling control mode to determine the cooling rate from the cooling rate table based upon the current target electrode temperature and the electrode temperature, and controls the cooling means at thus determined the cooling rate. Accordingly, it is made to cool the emitter electrode to an optimum temperature before applying the high voltage to discharge the charged minute water particles, assuring to give a sufficient amount of water on the emitter electrode.

In this instance, the controller determines a preliminary cooling period which varies with the above temperature difference obtained at the beginning of the initial cooling control mode, and continues the initial cooling control mode over this variable starting period, and takes the atomization control mode immediately thereafter.

Further, the target electrode temperature table is preferred to define an initial cooling ratio which varies with the above temperature difference between the target electrode temperature and the electrode temperature monitored at the beginning of the initial cooling control mode. In this instance, the controller operates in the initial cooling control mode to control the cooling means at the initial cooling ratio until the electrode temperature is lowered to around the target electrode temperature.

Further, the controller of the present invention may be configured to read, in the above initial cooling control mode or in the atomization control mode, the target electrode temperature from the target electrode temperature table based upon the current environmental temperature and humidity, and to control the cooling means until the target electrode temperature is reached. In this case, it is possible to make a temperature control without referring to the cooling rate table, and provides a suitable temperature control in match with the cooling means employed.

The target electrode temperature table is preferred to define the target electrode temperature which is higher than a freezing temperature. Thus, it is possible to avoid the freezing of the water on the emitter electrode for stable water condensation.

Further, it is preferred to control the cooling means for cooling the emitter electrode at a rapid cooling rate at the beginning of the initial cooling control mode, and thereafter control the cooling means to maintain the emitter electrode at the target electrode temperature.

Instead of monitoring the temperature of the emitter electrode, it is equally possible to predetermine a heat absorption amount in correspondence to the temperature of the emitter electrode, and to cool the emitter electrode to give the heat absorption amount in match with the target electrode temperature.

Preferably, the controller is configured to stop operating the cooling means and the application of the high voltage when the electrode temperature is lowered to the freezing temperature or below, ensuring to discharge the charged minute water particles only at an optimum condition.

Further, the controller may be configured to apply the high voltage across the two electrodes only while the emitter electrode is kept in such as condition as to allow the condensation of water, assuring a stable operation.

BEST MODE FOR CARRYING OUT THE INVENTION

1st Embodiment

Figure 1:
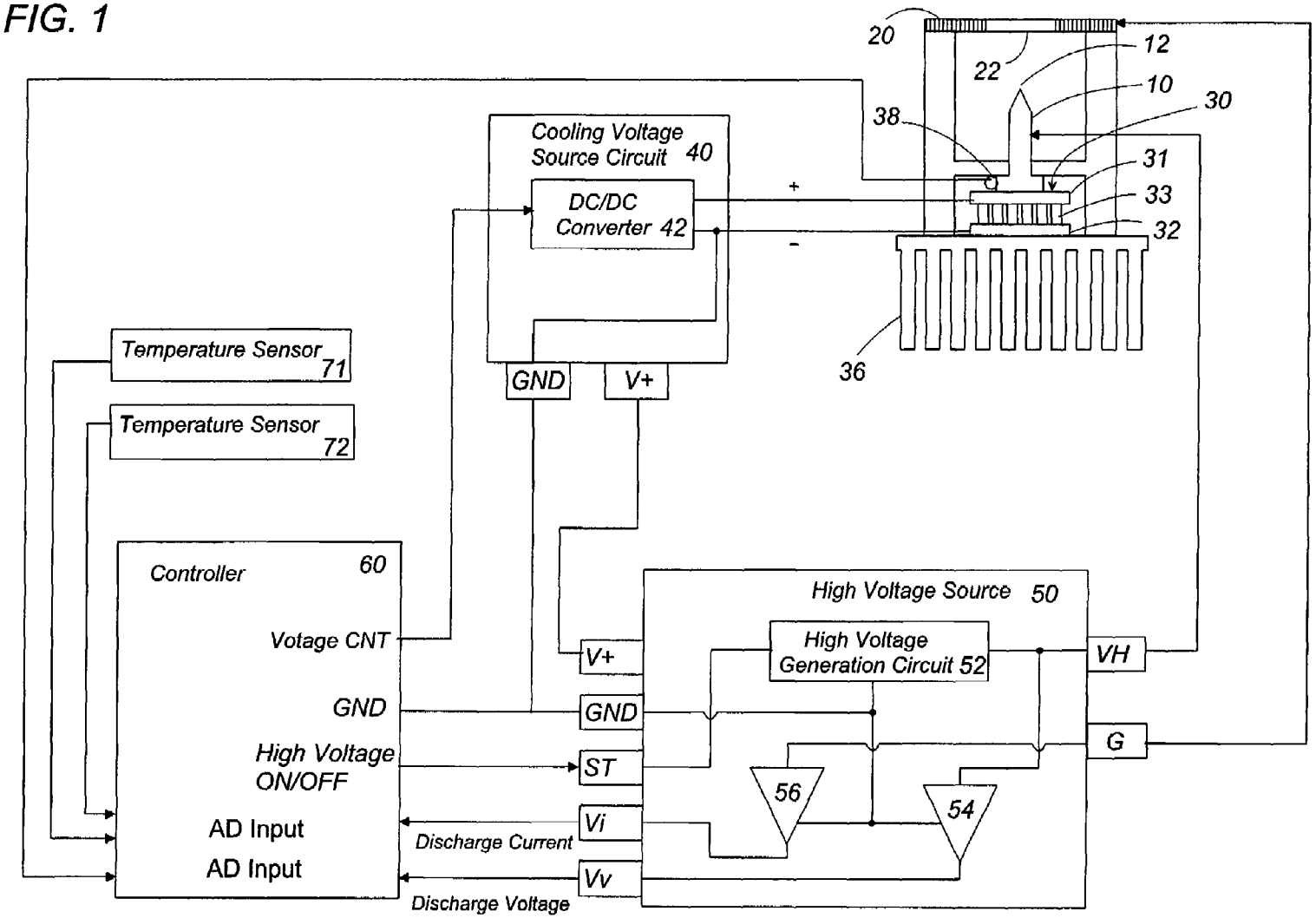
FIG. 1 is a block diagram of an electrostatically atomizing device in accordance with a first embodiment of the present invention.

An electrostatically atomizing device in accordance with the first embodiment of the present invention is explained with reference to the attached drawings. As shown in FIG. 1, the electrostatically atomizing device includes an emitter electrode 10 and an opposed electrode 20 disposed in an opposite relation to said emitter electrode 10. The oppose electrode 10 is shaped from an electrically conductive substrate with a circular opening 22 which has an inner periphery spaced by a predetermined distance from a discharge end 12 at the tip of the emitter electrode 10. The device includes a cooling means 30 which is coupled to the emitter electrode 10 for cooling thereof, and a high voltage source 50. The cooling means is configured to cool the emitter electrode 10 to condense the water content carried in the surrounding air on the emitter electrode 10 to supply the water thereto. The high voltage source 50 is configured to apply a high voltage across the emitter electrode 10 and the opposed electrode 20 so as to charge the water on the emitter electrode 10 and atomize it into charged minute water particles to be discharged from the discharge end.

The cooling means 30 is realized by a Peltier module having a cooling side coupled to the emitter electrode 10 at its one end away from the discharge end 12, and having thermoelectric elements which, upon being applied with a predetermined voltage, cools the emitter electrode to a temperature below a dew point of the water. The Peltier module has a plurality of thermoelectric elements arranged in parallel with each between thermal conductors 31 and 32 to cool the emitter electrode 10 at a cooling rate determined by a variable voltage given from a cooling electric source circuit 40. One thermal conductor 31 defining the cooling side is coupled to the emitter electrode 10, while the other thermal conductor 32 defining the heat radiation side is provided with heat radiating fins 36. The Peltier module is provided with a thermister 38 for monitoring the temperature of the emitter electrode 10.

The high voltage source 50 includes a high voltage generation circuit 52, a voltage detection circuit 54, and a current detection circuit 56. The high voltage generation circuit 52 is provided to apply a predetermined high voltage across the emitter electrode 10 and the grounded opposed electrode 20 to give a negative or positive voltage (for example, −4.6 kV) to the emitter electrode 10. The voltage detection circuit 54 is provided to monitor the voltage applied across the two electrodes, while the current detection circuit 56 monitors a discharge current flowing between the two electrodes.

The above device further includes a controller 60. The controller 60 controls the cooling voltage source 40 for regulating the cooling rate of the emitter electrode 10 and also controls the high voltage generation circuit 52 for turning on and off the voltage to be applied to the emitter electrode 10. The cooling voltage source 40 is provided with a DC-DC converter 42 which varies the voltage being applied to the Peltier module based upon a PWM signal of varying duty issued from the controller 60, thereby varying the cooling rate of the Peltier module. The controller 60 is coupled to a temperature sensor 71 for monitoring an environmental temperature of a room in which the electrostatically atomizing device is installed, a humidity sensor 72 for monitoring the humidity so as to regulate the cooling rate of the emitter electrode in accordance with the environmental temperature and humidity. These sensors are disposed in a housing forming an outer shell of the atomizing device or in a housing of an appliance such as an air purifier in which the atomizing device is incorporated.

The controller 60 provides two operational modes. One is an initial cooling control mode and the other is an atomization control mode executed after an elapse of a predetermined mode from the starting of the device. In the initial cooling control mode, only the cooling means 30 is controlled without accompanied with the high voltage application to give a sufficient amount of water (condensed water) to the emitter electrode. In the atomization control mode, the cooling means 30 as well as the high voltage generation circuit 52 are both controlled to atomize the charged minute water particles of nano-meter size from the emitter electrode 10 while keeping a sufficient amount of the water.

First, the initial cooling control mode is now explained.

1) Determination of a Target Electrode Temperature

Figure 2:
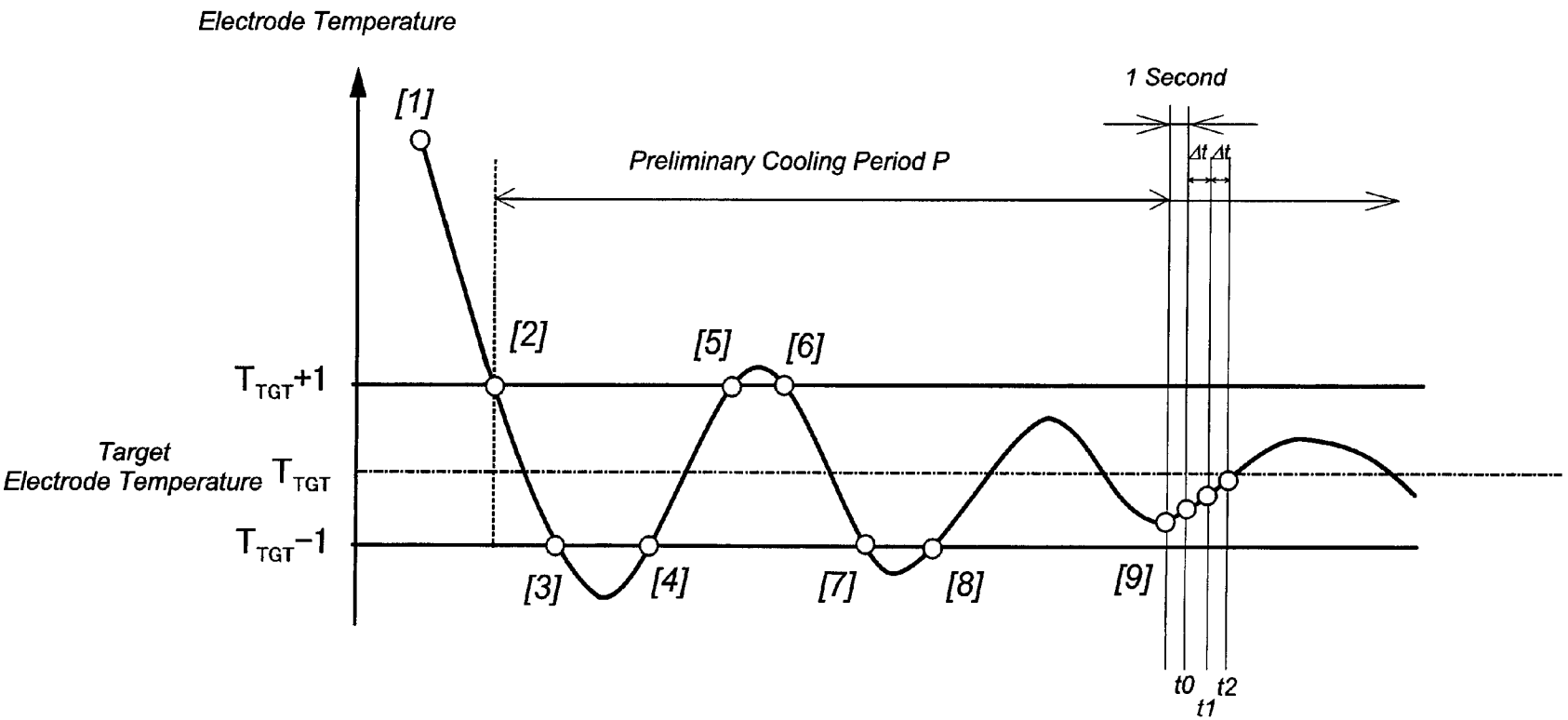
FIG. 2 is an explanatory view of the above device in its initial cooling control mode.

The controller 60 reads the environmental temperature and humidity from the sensors 71 and 72 at an operation starting time as indicated at [1] in FIG. 2, to determine the target electrode temperature ($T_{TGT}$) that gives a sufficient amount of water (condensed water) from the surrounding air. The target electrode temperature ($T_{TGT}$) is obtained from a target electrode temperature table predetermined within the controller, as shown in Table 1.

TABLE 1

Target Electrode Temperature Table

| Environmental Humidity Rh (%) | T < 5 | 5 ≦ T ≦ 10 | 10 < T ≦ 15 | 15 < T ≦ 20 | 20 < T ≦ 25 | 25 < T ≦ 30 | 30 < T ≦ 35 | 35 < T ≦ 40 | T > 40 |
|---|---|---|---|---|---|---|---|---|---|
| Rh ≧ 80 | 0 | 5 | 10 | 15 | 20 | 24 | 29 | | |
| 70 ≦ Rh < 80 | −1 | 3 | 8 | 13 | 17 | 22 | 27 | | |
| 60 ≦ Rh < 70 | −2 | 1 | 6 | 10 | 15 | 20 | 24 | | |
| 50 ≦ Rh < 60 | −3 | −1 | 3 | 7 | 12 | 17 | 21 | | |
| 40 ≦ Rh < 50 | | −3 | 0 | 4 | 8 | 13 | 17 | | |
| 30 ≦ Rh < 40 | | | −3 | 0 | 4 | 8 | 13 | | |
| 20 ≦ Rh < 30 | | | | −3 | −1 | 2 | 7 | | |
| 15 ≦ Rh < 20 | | | | | | −2 | 2 | | |
| 10 ≦ Rh < 15 | | | | | | | −1 | | |
| Rh < 10 | | | | | | | | | |

Environmental TemperatureT(° C.)

Figure 3:
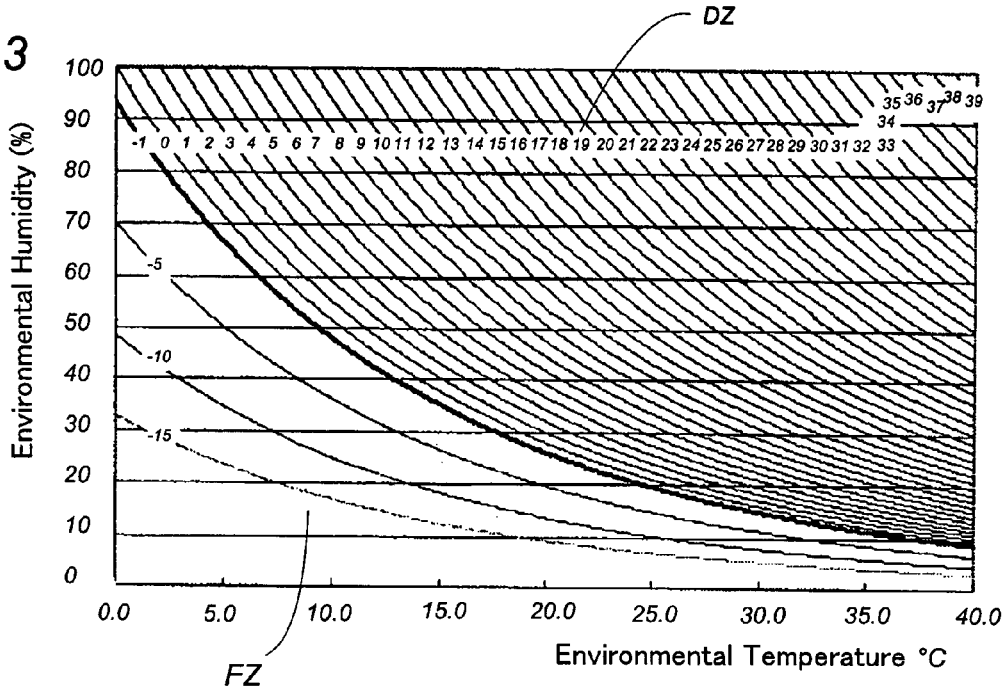
FIG. 3 is relied upon in the above device.

When the target electrode temperature is not specified, the controller acknowledges that a sufficient amount of water cannot be taken from the environment and gives a message to a user indicating the necessity of raising the temperature and humidity, and stops the operation until the environment satisfies a condition that can specify the target electrode temperature. In the above table 1, the target electrode temperature is selected so as not to freeze the water content in the surrounding air on the emitter electrode. That is, the above table is prepared based upon results which were obtained by cooling the Peltier module 30 to such an extent of causing condensation or freezing on the emitter electrode 10 with regard to various combinations of the environmental temperature and humidity as shown in FIG. 3. In the figure, curves denote the cooling temperatures of the Peltier module, and a region DZ indicates a region in which the condensation takes place, and a region FZ indicates a region in which the freezing takes place. Although the interface between the regions are determined by the cooling curve obtained by cooling the Peltier module to −1° C., the condensation region DZ may be extended to the cooling curve of −4° C.

2) Determination of Cooling Rate

Next, the controller 60 reads the electrode temperature of the emitter electrode 10 from the thermister 38 to obtain a temperature difference (ΔT) between the target electrode temperature ($T_{TGT}$) and the actual electrode temperature, and reads an initial cooling rate and a target cooling rate respectively as an initial duty and a target duty from a predetermined cooling rate table as indicated in table 2 below. The duty denotes a ratio (%) of the voltage being applied to the Peltier module per unit time. Thus, as the duty increases, the cooling rate is increased. Equivalent duties D(n) in the table is duties of 0 to 100% divided by 256, therefore D(96) corresponds to 38% duty, and D(225) corresponds to 99% duty. The cooling of the Peltier module is controlled by a PWM control using the equivalent duties.

TABLE 2

Cooling Rate Table

| Temperature Difference(ΔT) (=Electrode Temp − Target Electrode Temp) | Initial Duty | Equivalent Initial Duty D(n) | Target Duty | Equivalent Target Duty D(n) |
|---|---|---|---|---|
| 0 ≦ ΔT < 5 | 38 | D(96) | 1 | D(0) |
| 5 ≦ ΔT < 7.5 | 69 | D(176) | 6.6 | D(16 |

TABLE 2-continued

Cooling Rate Table

| Temperature Difference(ΔT) (=Electrode Temp − Target Electrode Temp) | Initial Duty | Equivalent Initial Duty D(n) | Target Duty | Equivalent Target Duty D(n) |
|---|---|---|---|---|
| 7.5 ≦ ΔT < 10 | 80 | D(205) | 14.5 | D(36) |
| 10 ≦ ΔT < 12.5 | 99 (max) | D(255) | 22.3 | D(56) |
| 12.5 ≦ ΔT < 15 | 99 (max) | D(255) | 30.1 | D(76) |
| 15 ≦ ΔT < 17.5 | 99 (max) | D(255) | 37.9 | D(96) |
| 17.5 ≦ ΔT < 20 | 99 (max) | D(255) | 53.5 | D(136) |
| 20 ≦ ΔT < 22.5 | 99 (max) | D(255) | 61.3 | D(156) |
| 22.5 ≦ ΔT < 25 | 99 (max) | D(255) | 69.1 | D(176) |
| 25 ≦ ΔT < 27.5 | 99 (max) | D(255) | 84.8 | D(216) |
| 27.5 ≦ ΔT < 30 | 99 (max) | D(255) | 99 (max) | D(255) |
| 30 ≦ ΔT < 35 | 99 (max) | D(255) | 99 (max) | D(255) |
| 35 ≦ ΔT | 99 (max) | D(255) | 99 (max) | D(255) |

3) Start Cooling

As shown in FIG. 2, the controller 60 sets a target electrode temperature range between an upper limit ($T_{TGT}$+1) and an lower limit ($T_{TGT}$−1) which are obtained respectively by adding, for example, +1° C. and −1° C. to the target electrode temperature ($T_{TGT}$), and control the Peltier module 30 to cool the emitter electrode 10 at the initial cooling rate from time [1]. Subsequently, upon lowering of the electrode temperature to the upper limit of the target electrode temperature at time [2], the cooling rate is switched to the target cooling rate (target duty). During times between [2] to [3], a control is made at the target cooling rate (target duty) determined in the above cooling rate table. Upon lowering of the electrode temperature below the lower limit of the target electrode temperature at time [3], the equivalent duty is lowered by one step. When the electrode temperature rises to the lower limit at time [4], the cooling is made at the target cooling rate determined in the cooling rate table. Upon the electrode temperature rising above the target upper limit, the equivalent duty is lowered by one step to lower the electrode temperature. Thereafter, the like control is made between times [6] and [9]. Time [9] is defined to be a time elapsed by a predetermined time period after time [2] when the electrode temperature lowered first to the target upper limit, and the predetermined time period defines a preliminary cooling period P. The preliminary cooling period P is a variable period which varies depending upon the temperature difference ΔT (=electrode temperature−target electrode temperature) at the start of the cooling. The preliminary cooling period P is determined to be 30 seconds when ΔT is 5° C. or less, 60 seconds when ΔT is 5° C. to 10° C., and 90 seconds when ΔT is 10° C. or more. That is, the preliminary cooling period P is shortened on a condition that the condensation on the emitter electrode is readily possible, and is prolonged on a condition that the condensation is not readily possible, thereby securing a sufficient amount of water on the emitter electrode 10 before starting the atomization of the charged minute water particles from the emitter electrode. After completing the preliminary cooling period P at time [9], the controller 60 shifts into the atomization control mode.

Next, the atomization control mode is explained.

Figure 4:
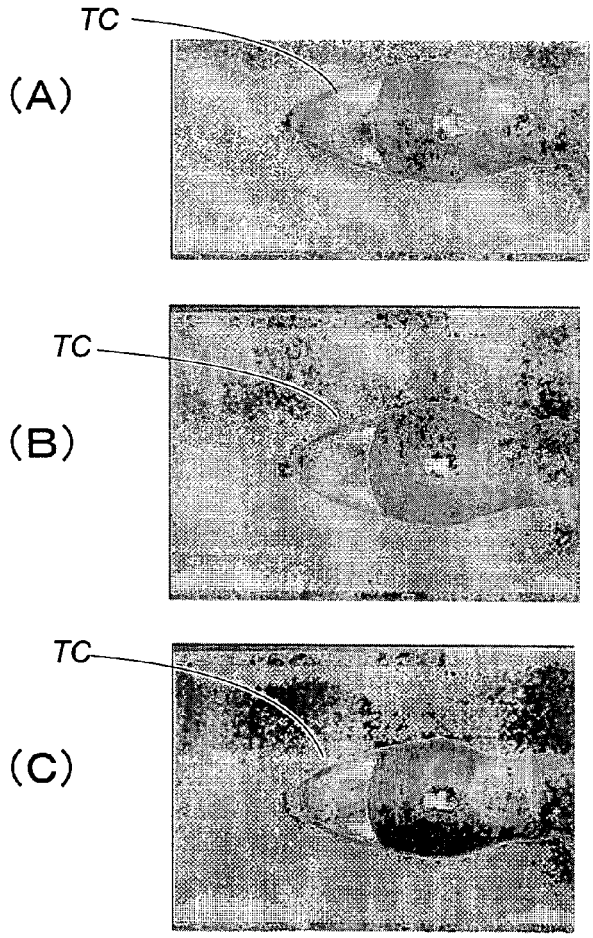
FIGS. 4(A), 4(B), 4(C), and 4(D) are explanatory views respectively of tailored cones formed at the tip of an emitter electrode of the above device.

In the atomization control mode, the charged minute water particles are discharged from the emitter electrode 10 while the emitter electrode is being supplied with a sufficient amount of condensed water. Whether or not the sufficient amount of the condensed water is being supplied can be judged by the discharge current flowing between the emitter electrode and the opposed electrode. That is, as shown in FIG. 4, when the sufficient amount of water is supplied, it is seen that the tailor cone TC of the water formed at the instance of being discharged from the emitter electrode becomes large. Thus, the discharge current varying in proportion to the size of the tailor cone is utilized as a parameter indicative of the discharging condition. The Rayleigh disintegration occurs at the tip of the tailor cone to atomize the charge minute water particles of nano-meter size. For example, when the tailor cone becomes small as a result of deficiency of the condensed water, as shown in FIG. 4(A), the discharge current is 3.0 μA. When the tailor cone of medium size is seen, as shown in FIG. 4(B), the discharge current is 6.0 μA. When the tailor cone becomes large as shown in FIG. 4(C), the discharge current is 9.0 μA. For example, FIG. 4(A) shows the deficient amount of the water being supplied, FIG. 4(B) shows an adequate amount of the water being supplied, and FIG. 4(C) shows an excessive amount of the water being supplied. Thus, the cooling rate at the Peltier module 30 is regulated in accordance with the discharge current.

Further, since the discharge current varies with a voltage being applied to the emitter electrode, a target discharge current indicative of an adequate supplying amount of the water is determined from a target discharge current table, as shown in table 3 below, so as to vary in accordance with the voltage.

TABLE 3

Target Discharge Current Table

| Discharge Voltage V(n) | Target Discharge Current: Lower Limit (I(n)min) | Median $<I_{TGT}>$ | Upper Limit (I(n)max) |
|---|---|---|---|
| 4.1 ≦ V(n) < 4.2 | I1 − a1 | I1 | I1 + a1 |
| 4.2 ≦ V(n) < 4.3 | I2 − a2 | I2 | I2 + a2 |
| 4.3 ≦ V(n) < 4.4 | I3 − a3 | I3 | I3 + a3 |
| 4.4 ≦ V(n) < 4.5 | I4 − a4 | I4 | I4 + a4 |
| 4.5 ≦ V(n) < 4.6 | I5 − a5 | I5 | I5 + a5 |
| 4.6 ≦ V(n) < 4.7 | I6 − a6 | I6 | I6 + a6 |
| 4.7 ≦ V(n) < 4.8 | I7 − a7 | I7 | I7 + a7 |
| 4.8 ≦ V(n) < 4.9 | I8 − a8 | I8 | I8 + a8 |
| 4.9 ≦ V(n) < 5.0 | I9 − a9 | I9 | I9 + a9 |
| 5.0 ≦ V(n) < 5.1 | I10 − a10 | I10 | I10 + a10 |
| 5.1 ≦ V(n) < 5.2 | I11 − a11 | I11 | I11 + a11 |

1) Reading Discharge Voltage and Discharge Current

When the atomization control mode is reached at time [9] in FIG. 2, the controller 60 starts applying the high voltage to the emitter electrode 10 to thereby start atomizing the charge minute water particles from the emitter electrode. Regarding the control of the Peltier module, the controller 60 determines the target electrode temperature based from the environmental temperature and humidity in the like manner as in the above initial cooling control mode, to keep cooling at the corresponding cooling rate (target duty) D, while adding a predetermined duty correction ΔD to the target duty D in order to keep the discharge current around the target discharge current defined in Table 3. The duty correction ΔD is determined by the discharge current and the target discharge current, as explained in the below.

Figure 5:
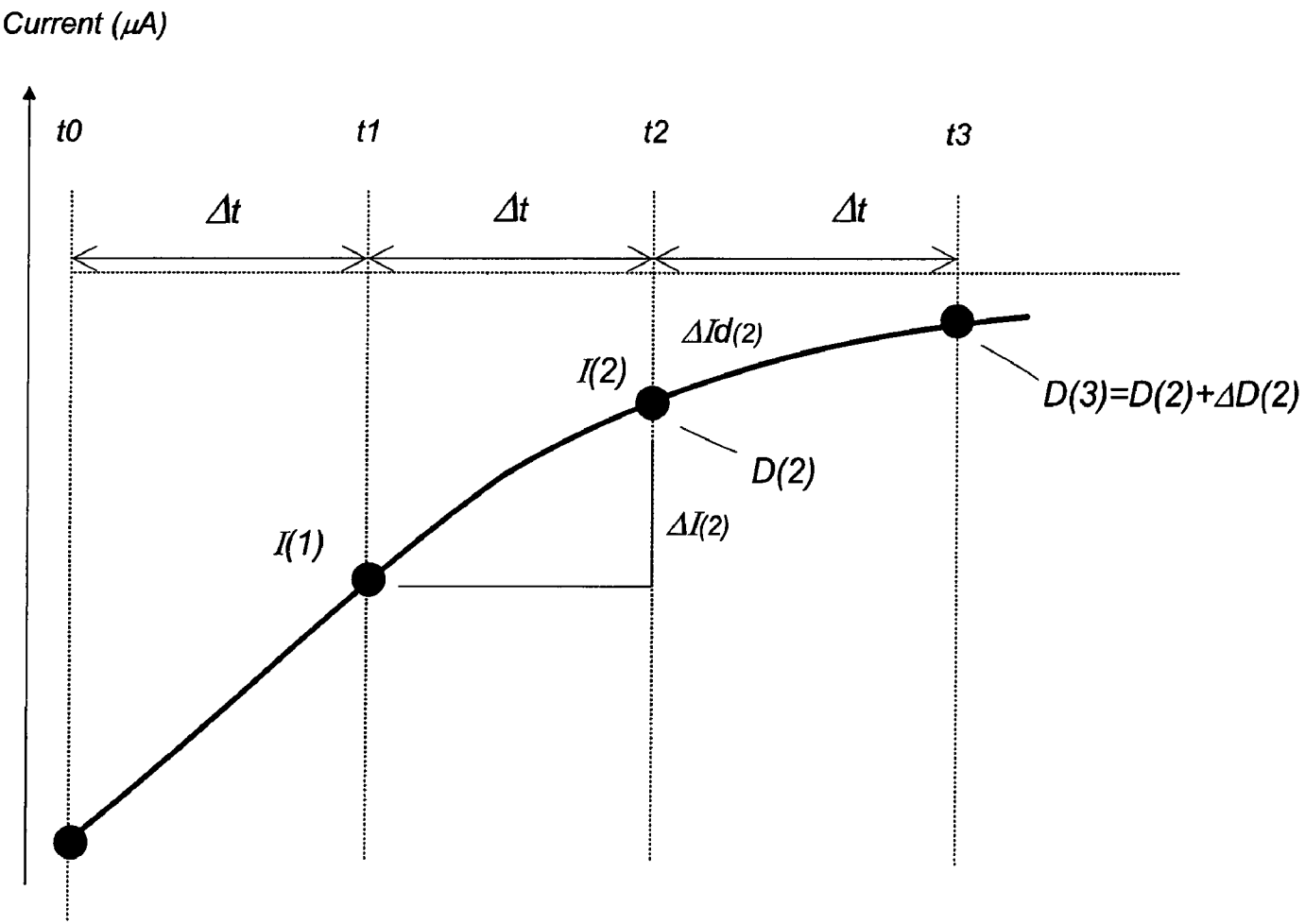
FIG. 5 is an operation explaining view of an atomization control mode of the above device.

In order to calculate the duty correction ΔD, the controller 60 starts reading the discharge voltage and the discharge current respectively from the voltage detection circuit 54 and the current detection circuit 56 at time t0 which is short time (for example 1 second) after time [9] at which the high voltage starts to be applied to the emitter electrode, as shown in FIGS. 2 and 5, and determines a first discharge voltage V(1) and a first discharge current I(1) at time t1 after the elapse of a predetermined time period Δt. Δt is set to be 6.4 seconds within which the discharge voltage and discharge current are read out each 0.32 seconds interval to determine V(1) and I(1) respectively as the averages thereof.

2) Determination of Duty Correction ΔD

As shown in FIG. 5, the controller 60 determines the second discharge current I(2) at time t2 which is after the elapse of Δt from time t1 in the same manner, and to obtain a discharge current variation (ΔI(2)=I(2)−I(1)) between the first and second discharge currents. Also, the controller 60 refers to the target discharge current table to read out the target discharge current $I_{TGT}$(1) corresponding to the first discharge voltage V(1) to obtain a discharge current error ΔId(2) (=$I_{TGT}$(1)−I(2)) between the target discharge current and the discharge current at time t2.

The controller 60, based upon the duty D(2) indicative of the cooling rate between t1 to t2, and the discharge current variation ΔI(2) determined at time t2, and the target discharge current error ΔId, determines the duty correction ΔD(2) by the following equation which includes a compensation parameter F{D(1)}.

$$\Delta D(2)=(a\times\Delta Id(2)-b\times\Delta I(2))\times F\{D(1)\} \quad \text{(Equation 1)}$$

wherein a and b are constant (=0.3), and F{D(1)} is the compensation parameter determined as corresponding to the cooling rate (duty) during time t1 to t2, as shown in the following table 4 below.

TABLE 4

Compensation Parameter Table

| Duty | F{D(n − 1)} |
|---|---|
| D(n − 1) = 1 | 0.5 |
| 1 < D(n − 1) ≦ 10 | 0.5 |
| 10 < D(n − 1) ≦ 20 | 1.0 |
| 20 < D(n − 1) ≦ 30 | 1.0 |
| 30 < D(n − 1) ≦ 40 | 1.0 |
| 40 < D(n − 1) ≦ 50 | 1.0 |
| 50 < D(n − 1) ≦ 60 | 1.0 |
| 60 < D(n − 1) ≦ 70 | 1.0 |
| 70 < D(n − 1) ≦ 80 | 1.0 |
| 80 < D(n − 1) ≦ 90 | 1.0 |
| 90 < D(n − 1) ≦ 100 | 1.0 |
| 100 < D(n − 1) ≦ 110 | 1.5 |
| 110 < D(n − 1) ≦ 120 | 1.5 |
| 120 < D(n − 1) ≦ 130 | 1.5 |
| 130 < D(n − 1) ≦ 140 | 1.5 |
| 140 < D(n − 1) ≦ 150 | 2.0 |
| 150 < D(n − 1) ≦ 160 | 2.0 |
| 160 < D(n − 1) ≦ 170 | 2.0 |
| 170 < D(n − 1) ≦ 180 | 2.0 |
| 180 < D(n − 1) ≦ 190 | 2.0 |
| 190 < D(n − 1) ≦ 200 | 2.5 |
| 200 < D(n − 1) ≦ 210 | 2.5 |
| 210 < D(n − 1) ≦ 220 | 2.5 |
| 220 < D(n − 1) ≦ 230 | 2.5 |
| 230 < D(n − 1) ≦ 240 | 2.5 |
| 240 < D(n − 1) ≦ 255 | 2.5 |

From the above equation, the controller 60 determines the duty D(3) (=D(2)+AD(2)) for control until time t3 after the predetermined time period Δt from t2, and control the Peltier module at the cooling rate indicated by D(3) to cool the emitter electrode 10. As discussed in the above, D(2) is determined by the environmental temperature, the environmental humidity, and the electrode temperature at each time.

Subsequently, the same control is executed each time period Δt to vary ΔD in a direction of advancing the discharge current to the target discharge current. In this continuous feedback control, duty increment rate ΔD(n), target discharge current error ΔId(n), and discharge current variation ΔI(n) are expressed by the following general equations 2, 3, and 4.

$$\Delta D(n)=(a\times\Delta Id(n)-b\times\Delta I(n))\times F\{D(n-1)\} \quad \text{(Equation 2)}$$

$$\Delta Id(n)=I_{TGT}(n-1)-I(n) \quad \text{(Equation 3)}$$

$$\Delta I(n)=I(n)-I(n-1) \quad \text{(Equation 4)}$$

wherein I(n) denotes the discharge current at n-th occurrence after the start of discharging, and $I_{TGT}(n-1)$ is the target discharge current calculated from the discharge voltage at (n−1)-th occurrence.

In this manner, the temperature of the emitter electrode 10 is feedback controlled by monitoring the discharge current so as to keep the amount of the condensed water on the emitter electrode 10 constantly at an optimum level for generating the nano-sized mist, whereby the electrostatic atomization of generating the nano-sized mist can be made continuously without being interrupted.

It is noted that the environmental humidity relied upon in the above initial cooling control mode may be obtained without the use of an external sensor. In this instance, a high voltage is applied across the emitter electrode 10 and the opposed electrode 20 in the absence of the water on the emitter electrode to measure the discharge current and obtain an inter-electrode resistance (=discharge voltage/discharge current). In this condition, the atomization does not takes place due to the absence of the water, and the inter-electrode resistance is correlated with the water content in the air such that the humidity can be estimated from the inter-electrode resistance.

Figure 6:
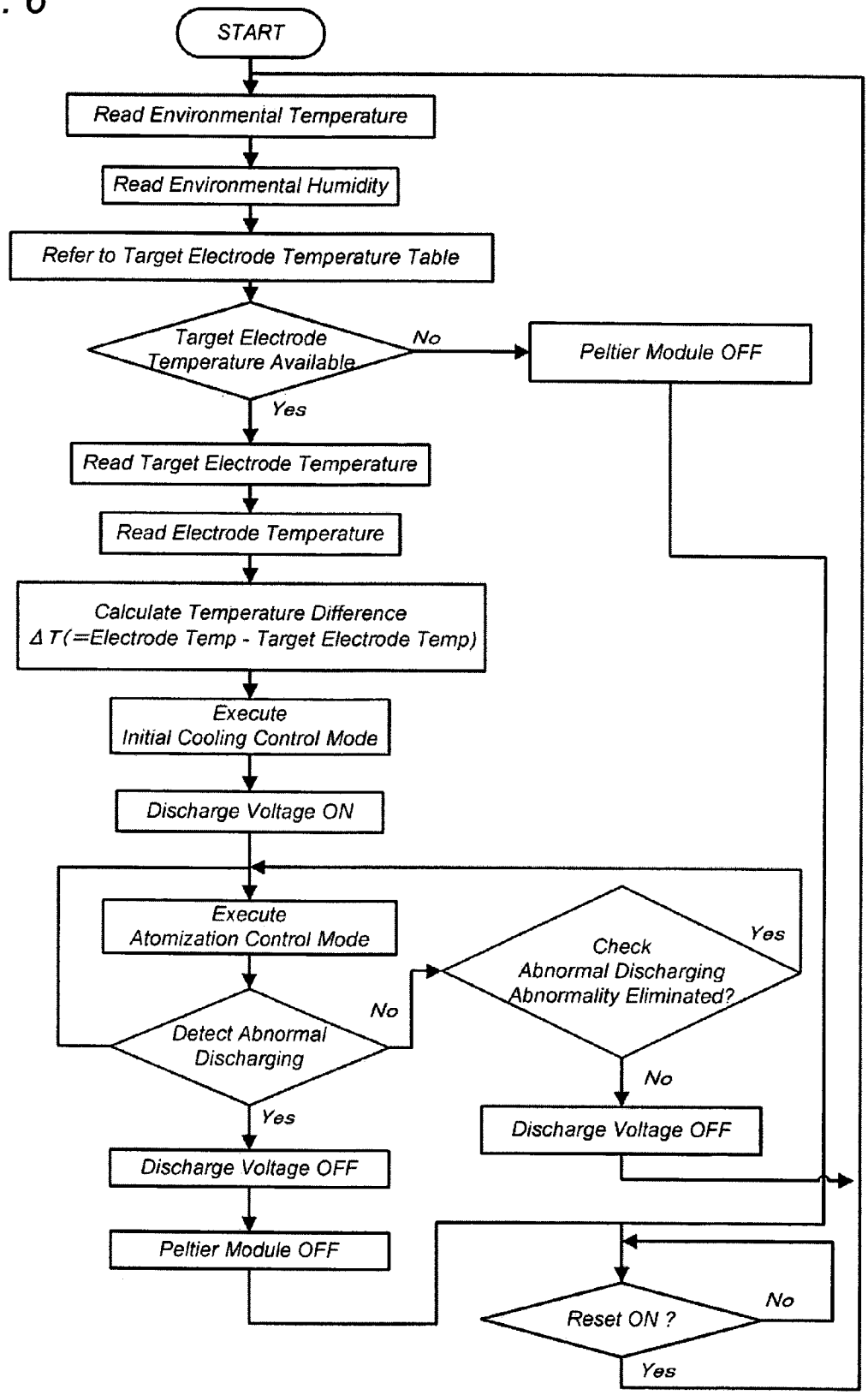
FIG. 6 is a flow chart illustrating the operation of the above device.

FIG. 6 is a flowchart illustrating the operations from the start to the atomization control mode through the initial cooling control mode. When the environmental temperature and humidity do not satisfy the condition that the target electrode temperature is available from the target electrode temperature table, a control is made to stop the Peltier module 30 and a sequence goes to a ready-position requiring a resetting of the device and waiting for the environment in which the condensation is available. The device is provided with a reset-button. In response to the reset-button being pressed by a user, a controller reads the environmental temperature and humidity, and is switched to the initial cooling control mode. If an abnormal discharging as explained in the below is detected while the atomization control mode is being executed, a control is made to check a cause of the abnormal discharging and return to the atomization control mode, or to stop applying the high voltage to the emitter electrode and stop the Peltier module followed by being switched to the reset waiting mode.

Abnormal Discharging Detection

The control in the atomization control mode continues so long as the discharge voltage V(n) is within the range indicated in Table 3, however it judges the occurrence of abnormality in the following situations to execute an abnormality process.

1) The detected discharge voltage V(n) becomes out of the range indicated in Table 3. That is, when the voltage is lower than 4.1 kV, the applied voltage is short so as not to keep the normal discharging, and when the voltage exceeds 5.2 kV, concentration of the electric field occurs to disable the normal discharging. In response to such occurrence, the controller 60 acknowledges the abnormal discharging to inform the user of such occurrence by use of indicator means such as a lamp and to stop the atomization and the cooling.

Figure 7:
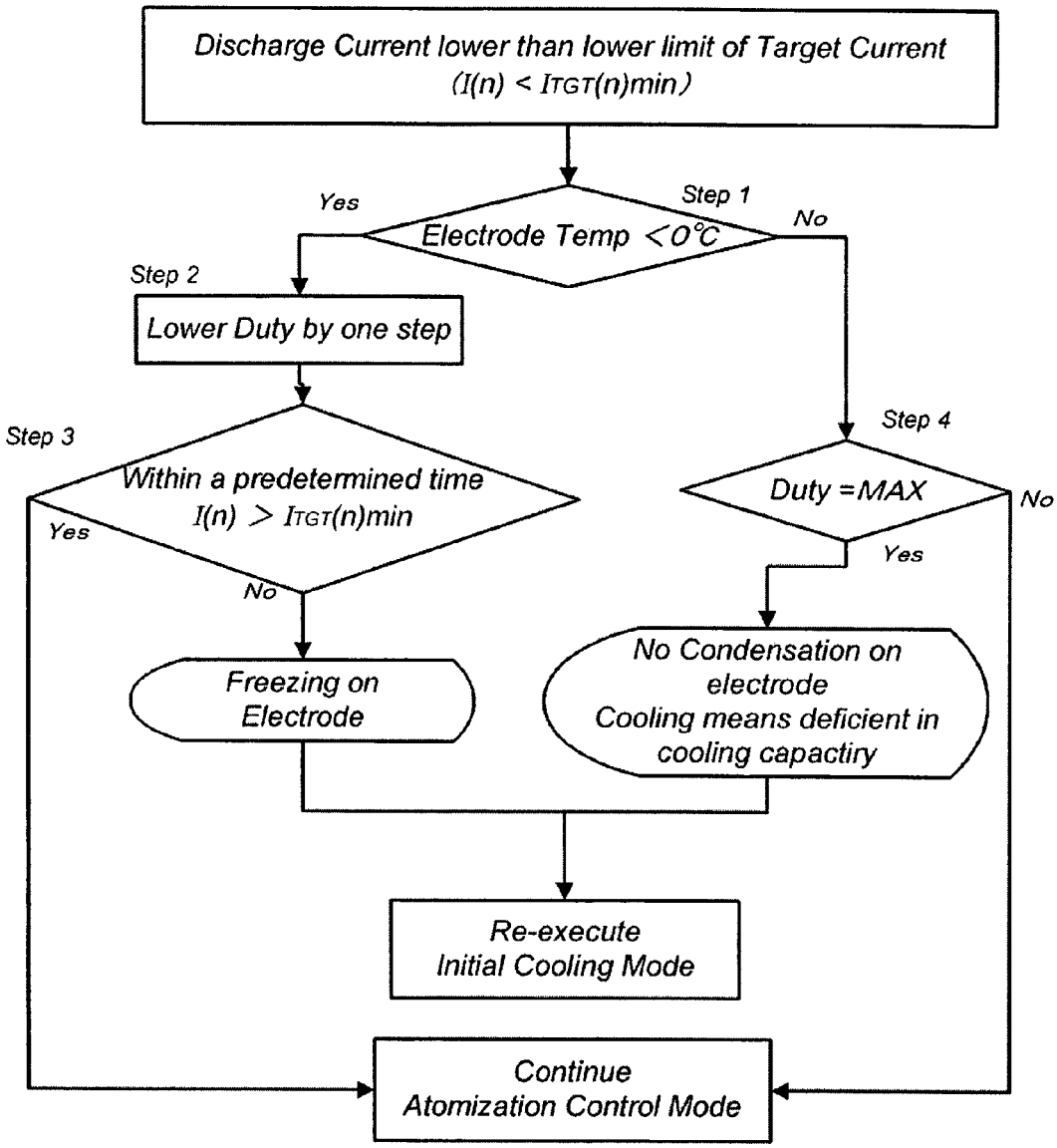
FIG. 7 is a flow chart illustrating a sequence at an abnormal discharging of the above device.

2) When the discharge current I(n) is found to be lower than a lower limit $I_{TGT}(n)_{min}$ which is the target discharge current $I_{TGT}(n)$ corresponding to the detected discharge voltage V(n) minus a predetermine value, it reflects that the emitter electrode 10 has no condensed water or suffers from the freezing. Thus, it is firstly checked whether or not the electrode temperature is below 0° C. (step 1) as shown in a flowchart of FIG. 7.

When the electrode temperature is below 0° C., indicating the freezing of the emitter electrode 10, a duty is lowered by one step to weaken the cooling at the Peltier module (step 2) followed by a step 3 in which it is checked whether the discharge current I(n) is above the lower limit $I_{TGT}(n)_{min}$. When the discharge current I(n) exceeds the lower limit $I_{TGT}(n)_{min}$, the control returns to the normal atomization control mode as a consequence of that the freezing disappears to secure the condensed water. Otherwise, it shows that the freezing still remains such that the control is made to stop discharging by applying no high voltage until the environmental temperature rises to dissolve the freezing, and returns to the initial cooling mode. As the environmental temperature rises in the initial cooling control mode, the target electrode temperature is correspondingly increased to thereby condense the water on the emitter electrode, after which the atomization control mode is caused to resume for atomizing the charged minute water particles.

On the other hand, when it is judged that the electrode temperature exceeds 0° C. at step 1 indicating the deficiency of the condensed water, a check is made whether or not the present duty is maximum (step 4). When the present duty is maximum, it indicates that the cooling means is deficient of cooling capacity in match with the environmental temperature so that the control is made to stop the discharging until the environmental temperature rises and return to the initial cooling control mode. When the present duty is not maximum, the control returns to the atomization control mode.

In the initial cooling control mode, the operation is stopped until the target electrode temperature is given from the temperature-humidity condition of Table 1 in correspondence to the rising of the environmental temperature, and the initial control mode becomes substantially active when the environment is expected to give a sufficient amount of the condensed water.

Figure 8:
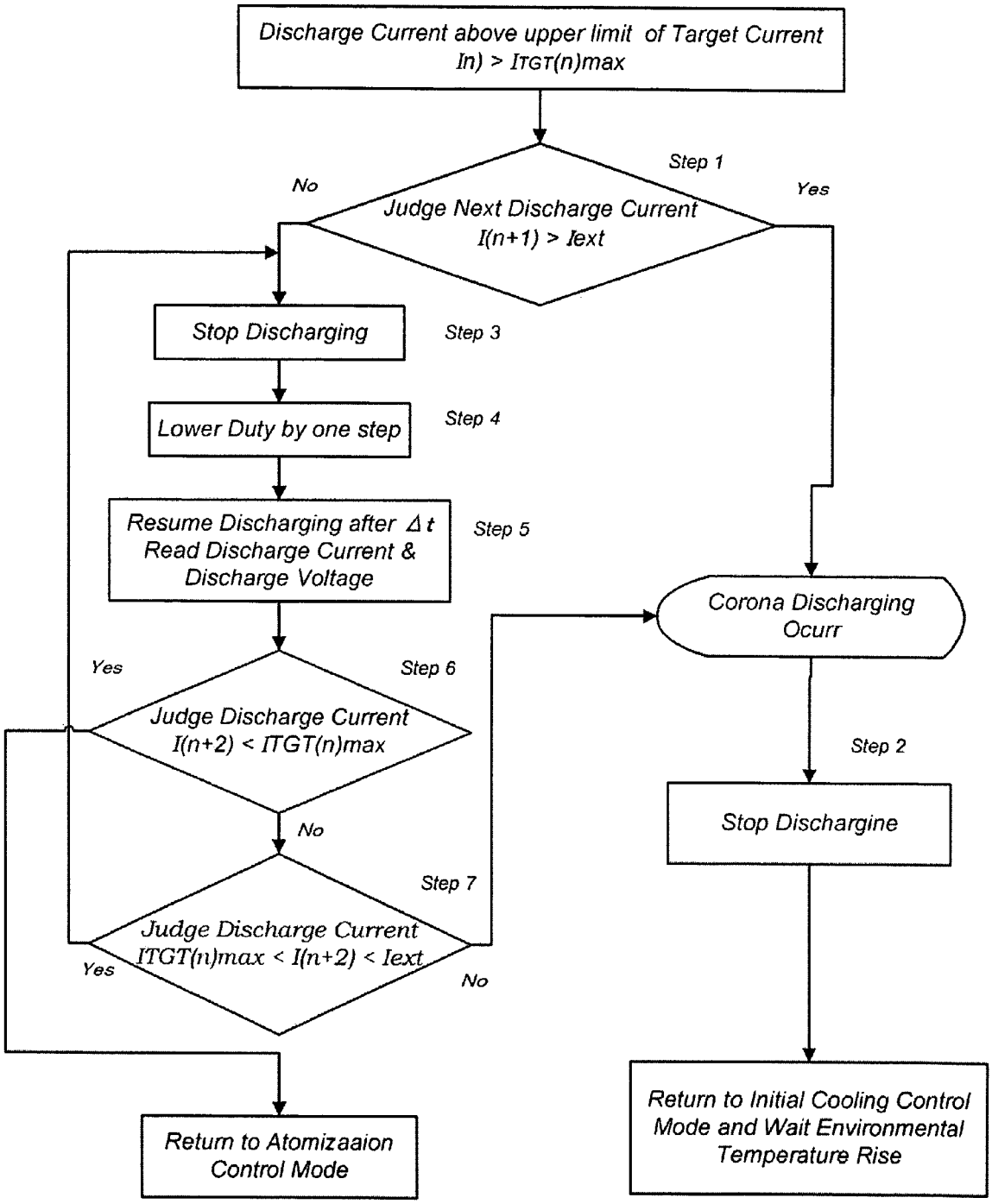
FIG. 8 is a flow chart illustrating another sequence at an abnormal discharging of the above device.

3) When the discharge current I(n) is found to exceed an upper limit $I_{TGT}(n)_{max}$ which is the target discharge current $I_{TGT}(N)$ corresponding to the detected discharge voltage V(n) plus a predetermine value, it reflects that the condensed water is excessive or the abnormal discharging (Corona discharging) occurs across the electrodes in the absence of the condensed water. For this purpose, it is checked, as shown at step 1 in a flowchart of FIG. 8, whether the next discharge current I(n+1) exceeds a maximum current Iext indicative of the abnormal discharging. When the discharge current exceeds the maximum current, it is judged that the abnormal discharging (Corona discharging) occurs so that the control is made to stop the discharging and returns to the initial cooling control mode at step 2, waiting for the environmental temperature rise that gives the increased target electrode temperature. Even when the next discharge current I(n+1) does not exceed the maximum current Iext indicative of the abnormal discharging, a control is made to stop the discharging (step 3), and lower the duty by one step (step 4), and resume discharging after the elapse of time Δt so as to read the discharge voltage and the discharge current (step 5). Subsequently, it is checked whether the discharge current I(n+2) exceeds the upper limit $I_{TGT}(n)_{max}$ of the target discharge current (step 6), and also the maximum current Iext (step 7). When the discharge current I(n+2) is found not to exceed the upper limit $I_{TGT}(n)_{max}$ of the target discharge current at step 6, the control returns to the atomizing control mode as a consequence of that the normal operating condition is back. When the discharge current I(n+2) is found to exceed the maximum current Iext, the control is made to stop the discharging and returns to the initial cooling control mode as a consequence of that the abnormal discharging continues. When the discharge current I(n+2) exceeds the upper limit $I_{TGT}(n)_{max}$ of the target discharge current but does not exceed the maximum current Iext, the sequence goes back to step 3.

Also when the discharge current variation ΔI(n) per unit time exceeds a predetermined level in the atomization control mode, the controller 60 judges the presence of the abnormal discharging to stop the discharging and is shifted to the reset-waiting condition. That is, while the discharging continues with the water on the emitter electrode 10, the discharge current will not vary abruptly. However, upon seeing considerably variation in the discharge current, the controller acknowledges some abnormality to stop the discharging and comes into a condition of waiting for the change of the environment.

Besides, the controller 60 judges the abnormality when the detected discharge current does not vary or vary in a direction opposite to that as intended in spite of that the applied voltage to the Peltier module 30 is varied to correspondingly vary the amount of the condensed water. For this purpose, the controller 60 is configured to obtain time series data of the discharge current and the duty of the voltage applied to the Peltier module, and take the ongoing discharge current I, integral value ΣΔD of the duty variation per each time period Δt, and integral value ΣΔI of the current variation ΔI per each time period Δt in order to whether the any one of the following conditions is satisfied. When satisfied, the controller judges the abnormality and stops applying the high voltage to the emitter electrode and stops applying the voltage to the Peltier module, thereafter shifting the control to the initial cooling control mode or the reset-waiting condition.

i) $I \geqq e$, $\Sigma\Delta D \geqq f$, and $-g < \Sigma\Delta I < g$ ii) $I \geqq e$, $\Sigma\Delta D \geqq f$, and $\Sigma\Delta I \leqq -g$ iii) $I \geqq e$, $\Sigma\Delta D \leqq -f$, and $-g < \Sigma\Delta I < g$ iv) $I \geqq e$, $\Sigma\Delta D \leqq -f$, and $\Sigma\Delta I \geqq g$ wherein e, f, and g are respectively predetermined values, for example, e=1 μA, f=50, g=1 μA, and integral values ΣΔD and ΣΔI are reset when the duty variation ΔD is reversed in its polarity.

The condition of i) indicates no variation of the discharge current, i.e., no increase of the supplying amount of the water even while that the applied voltage to the Peltier module 30 is increased to accelerate the cooling. The condition of ii) indicates the decrease of the discharge current decreases, i.e., the decrease of the supplying amount of water even while the applied voltage to the Peltier module 30 is increased to accelerate the cooling. The condition of iii) indicates no decrease of the discharge current, i.e., no variation of the supplying amount of the water even while the applied voltage to the Peliter module is decreased.

The condition o iv) indicates the increase of the discharge current, i.e., the increase of the supplying amount of the water even while the applied voltage to the Peliter module is decreased.

2nd Embodiment

The electrostatically atomizing device in accordance with the second embodiment of the present invention is basically identical to the first embodiment, except that a different scheme is utilized to adjusting the temperature of the emitter electrode to the target electrode temperature determined on the basis of the environmental temperature and humidity. In contrast to the first embodiment which discloses the PWM control scheme of controlling the Peltier module 30 by means of the duty D which is determined by the temperature difference ΔT between the electrode temperature and the target electrode temperature as seen in Table 2, the present embodiment discloses the control scheme of continuously varying the duty D except at the starting the device so as to cool the emitter electrode to the target electrode temperature determined by the environmental temperature and humidity.

Figure 9:
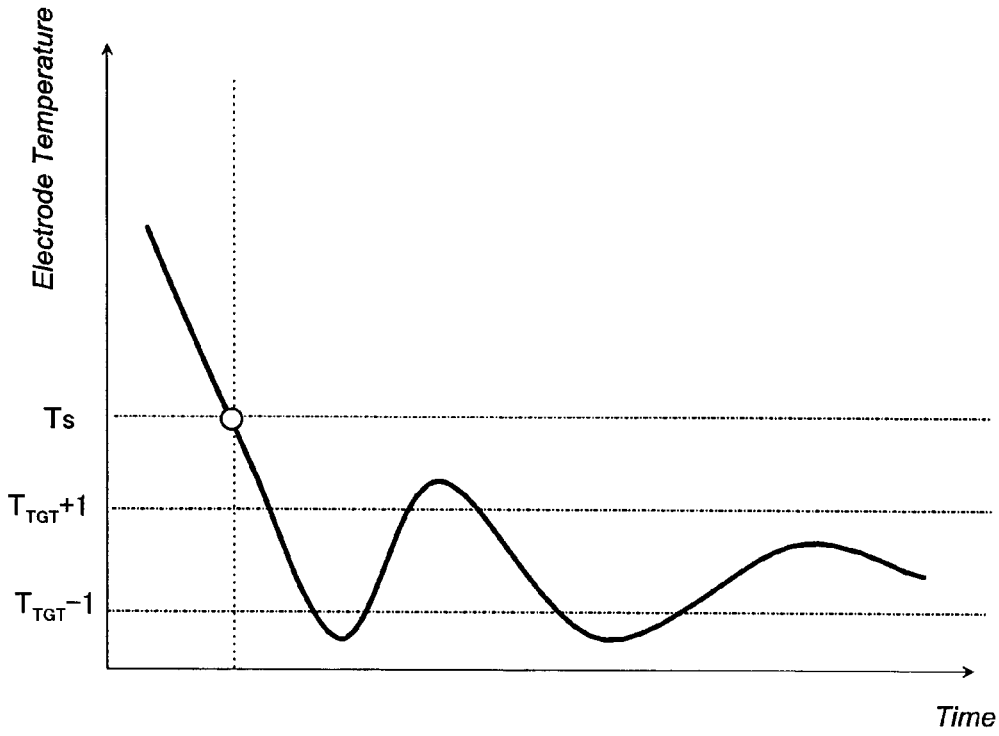
FIG. 9 is an operation explaining view of the electrostatically atomizing device in accordance with a second embodiment of the present invention.

The controller 60 reads the environmental temperature and humidity so as to obtain the target electrode temperature, from Table 1, that is responsible for generating sufficient amount of the condensed water on the emitter electrode 10, and sets a target electrode temperature range defined between an upper limit ($T_{TGT}$+1) and a lower limit ($T_{TGT}$−1) which are respectively given by adding +1° C. and −1° C. to the target electrode temperature, as shown in FIG. 9. At the start of operating the device, the Peltier module is cooled at the maximum duty D (=255, 99% duty) until the temperature of the emitter electrode 10 increases up to a temperature (Ts) slightly higher than the upper limit, thereafter the duty D is increased or decreased by one step in order to keep the temperature of the emitter electrode 10 between the upper and lower limits. That is, the duty is incremented, decremented, and maintained respectively in response to the ongoing electrode temperature exceeding the upper limit, exceeding the lower limit, and lying between the upper and lower limits. With this step-by-step duty control, it is possible to restrain excessive stress applied to the Peltier module.

In this instance, it is made to minimize the duty only when the electrode temperature comes first into the target electrode temperature range between the upper and lower limits, thereby avoiding the electrode temperature from lowering below the lower limit to a large extent. Further, a pseudo duty can be utilized instead of the minimum duty. The pseudo duty is determined by a difference between the electrode temperature and the lower limit of the target electrode temperature derived from the environmental temperature and humidity and the electrode temperature at the start of operating the device, and is selected such that the electrode temperature is slightly higher than the lower limit of the target electrode temperature.

In the above embodiments, the target electrode temperature table as shown in Table 1 is referred to for reading out the target electrode temperature in accordance with the environmental temperature and humidity. The table is arranged to divide the environmental temperature and humidity into relatively wide units (for example, 5° C. temperature unit and 10% humidity unit). In order to more precise temperature control, it is possible to use the table that defines the combinations of the environmental temperature and humidity in units of 5° C. temperature and 10% humidity, and to obtain the target electrode temperature by proportional calculation based upon nearest values of the temperature and humidity when the temperature and humidity are away from the unit scales thereof.

Figure 10:
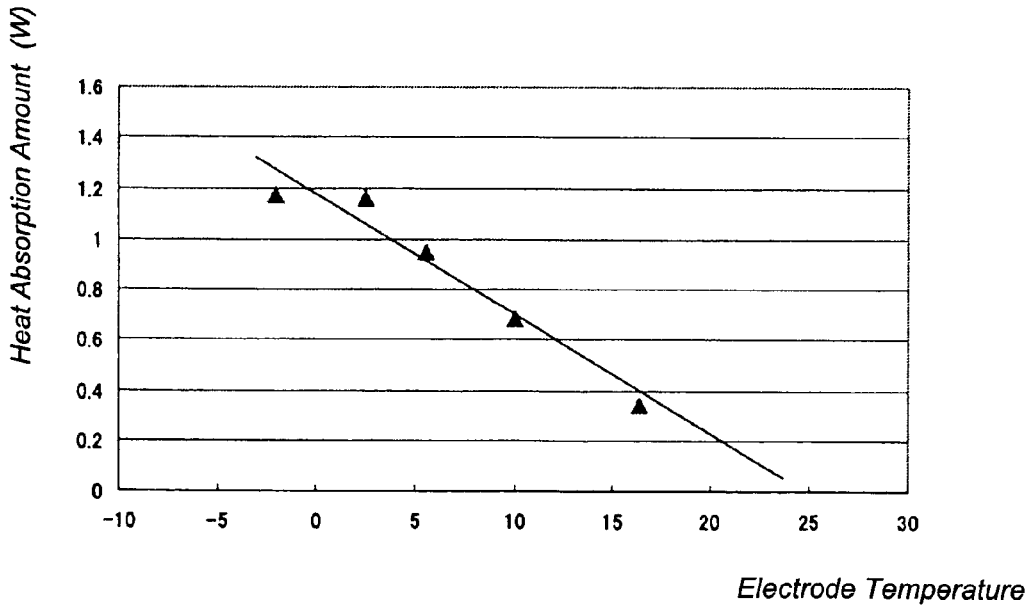
FIG. 10 is a graph explaining a scheme of calculating the temperature of the emitter electrode applicable to the present invention.

Also, it is equally possible to estimate the temperature of the emitter electrode based upon a heat absorption amount at the Peltier module 30 without using the temperature sensor monitoring the temperature of the emitter electrode. That is, as shown in FIG. 10, by obtaining a relation between the amount of heat absorption at the Peltier module 30 and the emitter electrode 10, and the temperature of the emitter electrode 10 in advance, and adding a function of calculating the heat absorption amount in terms of the electric power given to the Peltier module, it is possible to obtain the temperature of the emitter electrode 10. In this instance, the above control is made without the use of the thermister 38 shown in FIG. 1.

Further, although the above embodiments determines the timing of starting the atomization, i.e., ending the preliminary cooling control mode (end of the preliminary cooling period P in FIG. 2) based upon the time that varies with the environmental temperature and humidity, the controller may be configured to start the atomization when the electrode temperature reaches a predetermined temperature determined by the environmental temperature and humidity.

The invention claimed is:

1. An electrostatically atomizing device comprising:

an emitter electrode;

an opposed electrode opposed to said emitter electrode;

a cooling means configured to condense the water on said emitter electrode from within the surrounding air;

a high voltage source configured to apply a high voltage across said emitter electrode and said opposed electrode to electrostatically charge the water on said emitter electrode for atomizing charged minute water particles from a discharge end of said emitter electrode, and a controller configured to give an atomization control mode in which said controller monitors a parameter indicative of a discharging condition of said emitter electrode and controls said cooling means based upon said monitored parameter for regulating an atomizing amount of the charged minute water particles.

2. The device as set forth in claim 1, wherein said controller operates in said atomization control mode to monitor a discharge current between said electrodes as said parameter and varies a cooling rate of said cooling means for regulating the amount of the water condensed on said emitter electrode.

3. The device as set forth in claim 2, wherein said controller operates in said atomization control mode to monitor an environmental temperature and an environmental humidity of the surrounding air as well as an electrode temperature of said emitter electrode, and, said controller holding a target electrode temperature table defining a target electrode temperature which varies with said environmental temperature and humidity, a cooling rate table defining a cooling rate which varies with a temperature difference between said electrode temperature and said target electrode temperature, and a target discharge current table defining a target discharge current which varies in accordance with the high voltage currently applied across said electrodes, said controller operating in said atomization control mode to determine the cooling rate from said cooling rate table based upon said temperature difference;

said controller operating in said atomization control mode to collect time series data of said discharge current and said high voltage to read a first voltage and a first current at a first time, and read a second current at a subsequent second time, said controller reading said target discharge current from said target discharge current table in correspondence to said first voltage, said controller calculating a discharge current variation between the second current and the first current, and a target current error between said target discharge current and the second current, said controller operating in said atomization control mode to determine a correction of said cooling rate as a function of said discharge current variation and said target current error;

said controller controlling said cooling means, after said second time, to cool said emitter electrode at a corrected cooling rate which is said cooling rate plus said correction, and repeating a cycle of determining said corrected cooling rate with regard to subsequent ones of said time series data.

4. The device as set forth in claim 3, wherein said target discharge current table also defines a compensation parameter which varies with said cooling rate, said controller modifies the corrected cooling rate by said compensation parameter.

5. The device as set forth in claim 2, wherein said controller is configured to give an initial cooling control mode for cooling said emitter electrode without applying said high voltage across said electrodes, said controller operating in said initial cooling control mode to monitor an environmental temperature and an environmental humidity of the surrounding air, as well as an electrode temperature of said emitter electrode, and, said controller holding:

a target electrode temperature table defining a target electrode temperature which varies with the environmental temperature and humidity, and a cooling rate table defining a cooling rate which varies with a temperature difference between said target electrode temperature and said electrode temperature, said controller operating in said initial cooling control mode to determine said cooling rate from said cooling rate table based upon said temperature difference for controlling said cooling means at thus determined the cooling rate.

6. The device as set forth in claim 5, wherein said controller continues said initial cooling control mode over a preliminary cooling period which varies with said temperature difference obtained at the beginning of said initial cooling control mode, and takes said atomization control mode immediately thereafter.

7. The device as set forth in claim 5, wherein said target electrode temperature table defines an initial cooling ratio which varies with said temperature difference between said target electrode temperature and the electrode temperature monitored at the beginning of said initial cooling control mode, said controller operating in said initial cooling control mode to control said cooling means at said initial cooling ratio until said electrode temperature is lowered to around said target electrode temperature.

8. The device as set forth in claim 1, wherein said controller is configured to give an initial cooling control mode for cooling said emitter electrode without applying said high voltage across said electrodes, said controller operating in said initial cooling control mode to monitor an environmental temperature and an environmental humidity of said surrounding air, as well as an electrode temperature of said emitter electrode, said controller holding a target electrode temperature table defining a target electrode temperature which varies with the environmental temperature and the environmental humidity, said controller operating in said initial control mode to determine the target electrode temperature based upon said environmental temperature and humidity, and control said cooling means for cooling said emitter electrode until said emitter electrode reaches said target electrode temperature, and subsequently execute said atomization control mode.

9. The device as set forth in claim 2, wherein said controller is configured to give an initial cooling control mode for cooling said emitter electrode without applying said high voltage across said electrodes, said controller operating in said initial cooling control mode to monitor an environmental temperature and an environmental humidity of said surrounding air, as well as an electrode temperature of said emitter electrode, said controller holding:

a target electrode temperature table defining a target electrode temperature which varies with the environmental temperature and the environmental humidity, and a target discharge current table defining a target discharge current which varies in accordance with the high voltage currently applied across said electrodes, said controller operating in said initial control mode to determine the target electrode temperature from said target electrode temperature table based upon said environmental temperature and humidity, and to control said cooling means for cooling said emitter electrode until said emitter electrode reaches said target electrode temperature, and subsequently execute said atomization control mode, said controller operating in said spay control mode to monitor said environmental temperature and humidity as well as said electrode temperature, said controller operating in said atomization control mode to determine the target electrode temperature from said target electrode temperature table based upon the current environmental temperature and humidity, and obtain the cooling rate which maintains said emitter electrode at said target electrode temperature, said controller operating in said atomization control mode to collect time series data of said discharge current and said high voltage to read a first voltage and a first current at a first time, and read a second current at a subsequent second time, said controller reading said target discharge current from said target discharge current table in correspondence to said first voltage, said controller calculating a discharge current variation between the second current and the first current, and a target current error between said target discharge current and the second current, said controller operating in said atomization control mode to determine a correction of said cooling rate as a function of said discharge current variation and said target current error;

said controller controlling said cooling means, after said second time, to cool said emitter electrode at a corrected cooling rate which is said cooling rate plus said correction, and repeating a cycle of determining said corrected cooling rate with regard to subsequent ones of said time series data.

10. The device as set forth in claim 3, wherein said target electrode temperature table defines said target electrode temperature which is higher than a freezing temperature.

11. The device as set forth in claim 3, wherein said controller is configured to control said cooling means for cooling said emitter electrode at a rapid cooling rate at the beginning of said initial cooling control mode, and thereafter control said cooling means to maintain said emitter electrode at said target electrode temperature.

12. The device as set forth in claim 3, wherein said controller is configured to control said cooling means for cooling said emitter electrode to said target electrode temperature in terms of heat absorption characteristic of said emitter electrode.

13. The device as set forth in claim 3, wherein said controller is configured to stop operating said cooling means and the application of said high voltage when said electrode temperature is lowered to the freezing temperature or below.

14. The device as set forth in claim 3, wherein said controller is configured to apply said high voltage across said electrodes only while said emitter electrode is kept in such as condition as to allow the condensation of water.

15. The device as set forth in claim 9, wherein said target electrode temperature table defines said target electrode temperature which is higher than a freezing temperature.

16. The device as set forth in claim 9, wherein said controller is configured to control said cooling means for cooling said emitter electrode at a rapid cooling rate at the beginning of said initial cooling control mode, and thereafter control said cooling means to maintain said emitter electrode at said target electrode temperature.

17. The device as set forth in claim 9, wherein said controller is configured to control said cooling means for cooling said emitter electrode to said target electrode temperature in terms of heat absorption characteristic of said emitter electrode.

18. The device as set forth in claim 9, wherein said controller is configured to stop operating said cooling means and the application of said high voltage when said electrode temperature is lowered to the freezing temperature or below.

19. The device as set forth in claim 9, wherein said controller is configured to apply said high voltage across said electrodes only while said emitter electrode is kept in such as condition as to allow the condensation of water.

* * * * *